US006293196B1

(12) United States Patent
DeMoore et al.

(10) Patent No.: US 6,293,196 B1
(45) Date of Patent: Sep. 25, 2001

(54) HIGH VELOCITY, HOT AIR DRYER AND EXTRACTOR

(75) Inventors: Howard Warren DeMoore, Dallas; Howard Curtis Secor, Coppell, both of TX (US)

(73) Assignee: Howard W. DeMoore, Dallas, TX (US)

( * ) Notice: Subject to any disclaimer, the term of this patent is extended or adjusted under 35 U.S.C. 154(b) by 0 days.

(21) Appl. No.: 08/132,584

(22) Filed: Oct. 6, 1993

(51) Int. Cl.[7] ..... B41F 35/14

(52) U.S. Cl. ..... 101/424.1; 101/416.1; 101/483

(58) Field of Search ..... 101/424.1, 416.1, 101/483; 118/58, 621, 643; 34/418, 444

(56) References Cited

U.S. PATENT DOCUMENTS

| | | | | |
|---|---|---|---|---|
| 1,479,819 | * | 1/1924 | Kluever | 101/424.1 |
| 1,633,451 | * | 6/1927 | McLaughlin et al. | 101/416.1 |
| 1,634,649 | * | 7/1927 | Cook | 101/416.1 |
| 2,613,603 | * | 10/1952 | Ireton | 101/416.1 |
| 2,906,205 | * | 9/1959 | Speers | 101/416.1 |
| 2,941,062 | | 6/1960 | Halley | 219/39 |
| 3,068,119 | * | 12/1962 | Gotsch | 118/58 |
| 3,078,587 | | 2/1963 | Huck | 34/48 |
| 3,421,228 | | 1/1969 | Herbert, Jr. | 34/1 |
| 4,233,901 | | 11/1980 | Mallinson | 101/416 |
| 4,312,137 | * | 1/1982 | Johne et al. | 101/424.1 |
| 4,449,453 | | 5/1984 | Staffer et al. | 101/416 |
| 4,475,294 | * | 10/1984 | Henricks | 118/58 |
| 4,501,072 | | 2/1985 | Jacobi et al. | 34/1 |
| 4,756,091 | | 7/1988 | Van Denend | 34/4 |
| 4,841,903 | | 6/1989 | Bird | 118/46 |
| 4,882,992 | | 11/1989 | Schmoeger | 101/424.1 |
| 4,939,992 | | 7/1990 | Bird | 101/183 |
| 4,999,927 | | 3/1991 | Durst et al. | 34/23 |

FOREIGN PATENT DOCUMENTS

0128461 * 10/1988 (JP) .

* cited by examiner

*Primary Examiner*—John S. Hilten
*Assistant Examiner*—Anthony H. Nguyen
(74) *Attorney, Agent, or Firm*—Locke Liddell & Sapp LLP

(57) ABSTRACT

A hot air dryer utilizes high velocity air jets which scrub and break up the moist air layer which clings to the surface of a freshly printed sheet. High velocity air is heated to a high temperature as it flows along a resistance heating element within an air delivery baffle tube. The heated, high velocity air pressurizes a plenum chamber within an air distribution manifold. High velocity jets of hot air are discharged through multiple air flow apertures onto the wet ink side of a printed sheet as it moves through the dryer exposure zone. An extractor removes the moist air layer, high velocity hot air and volatiles from the printed sheet and exhausts it from the press.

28 Claims, 7 Drawing Sheets

10
52
53
70
72
74
76
78A
58
60
56
62
50
88
68
78
64A
64B
54
36W
46
T2
38
38C
38D
40C
64
64F
36
78B
7
48
78C
64E
Z

HIGH VELOCITY, HOT AIR DRYER AND EXTRACTOR

FIELD OF THE INVENTION

This invention relates generally to accessories for sheet-fed, rotary offset and flexographic printing presses, and in particular to a dryer for printed materials which utilizes high velocity, hot air flow and extraction.

BACKGROUND OF THE INVENTION

In the operation of a rotary offset press, an image is reproduced on a sheet of paper or some other printable stock by a plate cylinder which carries the image, a blanket cylinder which has an ink transfer surface for receiving the inked image, and an impression cylinder which presses the paper against the blanket cylinder so that the inked image is transferred to the paper. In some applications, a protective and/or decorative coating is applied to the surface of the freshly printed sheets. The freshly printed sheets are then transported to a sheet delivery stacker in which the printed sheets are collected and stacked.

In each press unit, a thin printing plate is mounted on a plate cylinder. The printing plate has image areas which are oleophilic and hydrophobic, and background areas which are oleophobic and hydrophilic. The plate surface is continuously wetted with aqueous damping solution, which adheres only to the background areas. The plate is inked with oleoresinous ink composition which adheres only to the image areas of the plate as wet ink. The ink is offset-transferred to the rubber surface of a contacting blanket cylinder, and is then retransferred to the receptive surface of a web or a succession of sheets, where the ink gradually hardens or cures by oxidation after passing through a final drying station downstream of the last press unit where the volatile solvent is evaporated from the inked image.

The relatively wet condition of the printing ink composition and its solvent and/or diluent components, and the presence of a layer of moisture laden air which clings to the surface of the web or sheet to the next printing unit may interfere with the quality of the images as they are printed at each succeeding printing unit. For example, the quality of colored images, half-tone illustrations and the like undergo degradation in the uniformity of their appearance and color because of the presence of the wet ink, volatiles, and moisture within the printed substrate. Moreover, protective coatings will undergo dilution and surface degradation causing a dull finish if the underlying substrate is not dried sufficiently before the coating is applied.

Such defects, including uneven surface appearance of protective/decorative coatings, detract from the appearance of the underlying images or photographs, particularly in the case of multi-colored images or photographs. The defects are caused by residual, volatile solvents, diluents, water and the like within the oleoresinous inks of the images, and the presence of moisture in the printed material, at the time that the next successive image is printed or the protective/decorative coating is applied. Because the defects are compounded as the printed material moves through successive printing units, it is desirable that curing and drying be initiated and volatiles and moisture laden air be extracted at each interstation position, as well as at the delivery position.

DESCRIPTION OF THE PRIOR ART

Since setting and curing of the inked image is gradual, it is desirable to accelerate the drying process. It is known to provide one or more interstation dryers in multiple-unit presses for the purpose of initiating the setting of the wet ink and extracting the volatiles and moisture laden air from each printing unit.

Hot air dryers and radiant heaters have been used as delivery dryers and as interstation dryers. Interstation dryers employing radiant heat lamps are best suited for slow to moderate press speeds in which the exposure time of each printed sheet to the radiant heat is long enough to initiate ink setting. For high speed press operation, for example, at 5,000 sheets per hour or more, there is not enough available space at the interstation position to install a radiant heater having sufficient number of heat lamps for adequate drying purposes.

As press speed is increased, the exposure time (the length of time that a printed sheet is exposed to the radiant heat) is reduced. Since the number of lamps is limited by the available interstation space, the output power of the radiant lamps has been increased to deliver more radiant energy at higher temperatures to the printed sheets in an effort to compensate for the reduction in exposure time. The increased operating temperatures of the high-powered radiant heat lamps cause significant heat transfer to the associated printing unit and other equipment mounted on the press frame, accelerated wear of bearings and alterations in the viscosities of the ink and coating, as well as upsetting the balance between dampening solution and ink. The heat build-up may also cause operator discomfort and injury.

To handle high speed press operations, an off-press heater has been utilized in which high velocity, heated air is conveyed through a thermally insulated supply duct to a discharge plenum which directs high velocity, heated air onto the printed stock as it travels by the interstation dryer position. Such off-press heaters have proven to be relatively inefficient because of excessive heat loss and pressure drop along the supply duct. Attempts to overcome the heat loss and pressure drop have resulted in substantially increased physical size of the heater equipment (blower fan and supply duct) along with a substantial increase in the electrical power dissipated by the off-press heater.

OBJECTS OF THE INVENTION

The principal object of the present invention is to increase the operating efficiency of a printing press dryer of the type which utilizes high velocity hot air flow to accelerate the drying of inks on freshly printed sheets.

A related object of the present invention is to provide a high efficiency, high velocity hot air dryer which includes improved means for extracting volatiles and moisture laden air from each printing unit, thereby accelerating the drying process.

Another object of the present invention is to provide a high velocity hot air dryer of the character described which is compact and capable of being operated effectively at high press speeds in the interstation position.

Yet another object of the present invention is to provide an improved high velocity hot air dryer of the character described in which the electrical power operating requirements are reduced as compared with comparable radiant dryers and offpress hot air heaters.

Still another object of the present invention is to provide an improved high velocity hot air dryer having a heater element, high velocity air plenum and extractor, with all components being mountable and operable on-press in the interstation position.

Another object of the present invention is to provide a high efficiency, high velocity hot air dryer which includes improved extractor for eliminating the transfer of heat to nearby press parts and equipment.

SUMMARY OF THE INVENTION

The foregoing objects are achieved according to the present invention by a high velocity hot air dryer in which high velocity air from an off-press supply is heated by an internal resistance heating element. Heated air at high pressure is discharged uniformly through precision holes located in an air distribution manifold onto a freshly printed sheet as it moves along a sheet transfer path from one printing unit to the next printing unit.

According to one aspect of the present invention, the moist air layer is displaced from the surface of the printed sheet by high-velocity hot air jets which scrub and break-up the moisture-laden air layer that adheres to the printed surface of the sheet. The high-velocity hot air jets create turbulence which overcomes the surface tension of the moisture and separates the moisture laden air from the surface of the printed material. The moisture laden air becomes entrained in the forced air flow and is removed from the printing unit by a high volume extractor.

The scrubbing action of the high velocity hot air jets is improved by adjacent rows of multiple discharge apertures which are oriented to deliver a converging pattern of high velocity hot air jets into an exposure zone across the sheet travel path. The high velocity hot air jets are produced by a pair of elongated dryer heads in which high velocity air is heated by heat transfer contact with a resistance heating element within an air delivery baffle tube. Since the release of moisture and other volatiles from the ink and printed material occurs continuously in response to the absorption of thermal energy, the moisture laden air layer is displaced continuously from the printed sheet as the printed sheet travels through the exposure zone in contact with the converging hot air jets.

The moisture-laden air is completely exhausted from the printing unit by a high volume extractor. An extractor manifold is coupled to a pair of elongated dryer heads and draws the moisture-laden air, volatiles and high velocity hot air from the exposure zone through a longitudinal air gap between the dryer heads. According to this arrangement, the drying of each printed sheet is initiated and accelerated before the sheet is run through the next printing unit.

Operational features and advantages of the present invention will be understood by those skilled in the art upon reading the detailed description which follows with reference to the attached drawings, wherein:

DETAILED DESCRIPTION OF THE PREFERRED EMBODIMENT

As used herein, the term "processed" refers to various printing processes which may be applied to either side of a sheet, including the application of inks and/or coatings. The term "substrate" refers to sheet material or web material.

Figure 1:
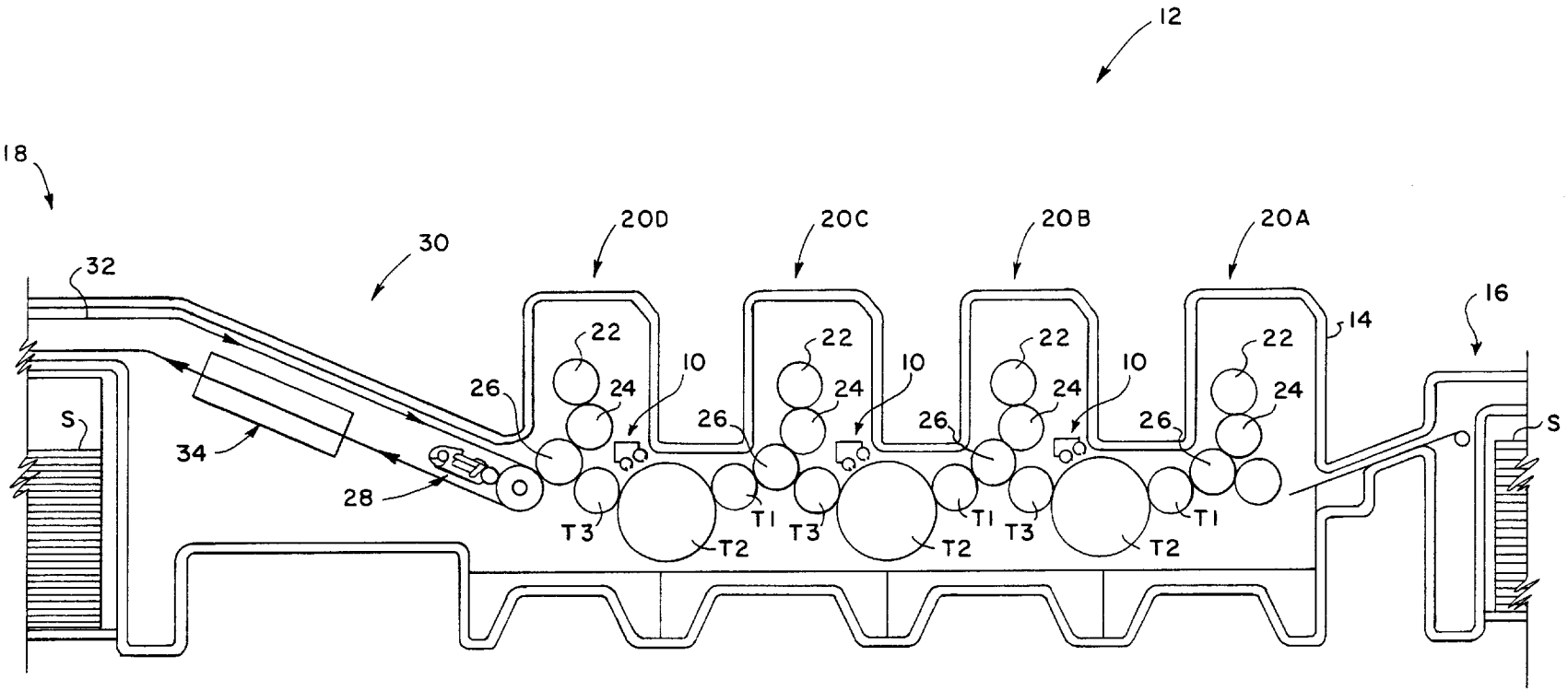
FIG. 1 is a schematic side elevational view in which multiple dryers of the present invention are installed at interstation positions in a four color offset rotary printing press.

Referring now to FIG. 1, the high velocity hot air dryer 10 of the present invention will be described as used for drying freshly printed substrates, which are successively printed at multiple printing units in a sheet-fed, rotary offset printing press. In the exemplary embodiment, the dryer 10 of the present invention is installed at an interstation position between two printing units of a four color printing press 12 which is capable of handling individual printed sheets having a width of the approximately 40" (102 centimeters) and capable of printing 10,000 sheets per hour or more, such as that manufactured by Heidelberg Druckmaschinen AG of Germany under its designation Heidelberg Speedmaster 102V.

The press 12 includes a press frame 14 coupled on the right end to a sheet feeder 16 from which sheets, herein designated S, are individually and sequentially fed into the press, and at the opposite end, with a sheet stacker 18 in which the printed sheets are collected and stacked. Interposed between the sheet feeder 16 and the sheet stacker 18 are four substantially identical sheet printing units 20A, 20B, 20C and 20D which can print different color inks onto the sheets as they are moved through the press.

As illustrated in FIG. 1, each sheet fed printing unit is of conventional design, each unit including a plate cylinder 22, a blanket cylinder 24 and an impression cylinder 26. Freshly printed sheets S from the impression cylinder 26 are transferred to the next printing unit by transfer cylinders T1, T2, T3.

A protective coating may be applied to the printed sheets by a coating unit 28 which is positioned adjacent to the last printing unit 20D. The coating unit 28 is preferably constructed as disclosed in U.S. Pat. No. 5,176,077, which is incorporated herein by reference.

The freshly printed and coated sheets S are transported to the sheet stacker 18 by a delivery conveyor system, generally designated 30. The delivery conveyor 30 is of conventional design and includes a pair of endless delivery gripper chains 32 carrying laterally disposed gripper bars having a gripper element for gripping the leading edge of a freshly printed sheet S as it leaves the impression cylinder 26. As the leading edge of the printed sheet S is gripped by the grippers, the delivery chains 32 pull the gripper bar and sheet S away from the impression cylinder 26 and transports the freshly printed and/or coated sheet to the sheet stacker 18.

Prior to delivery, the freshly printed sheets S pass through a delivery dryer 34 which includes a combination of infrared thermal radiation, forced air flow and extraction.

Figure 2:
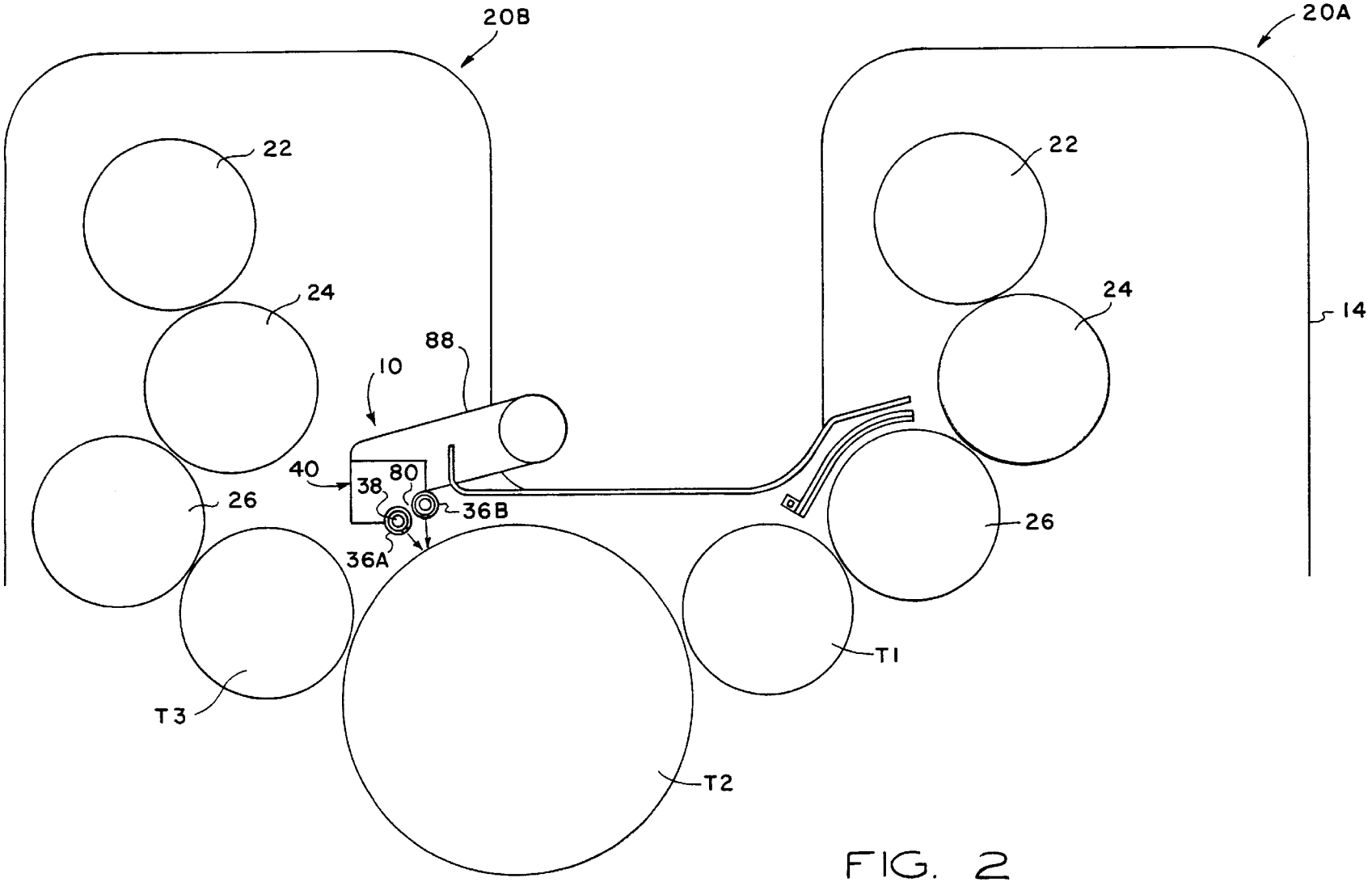
FIG. 2 is a simplified side elevational view showing the dryer of the present invention installed in an interstation position between two printing units of FIG. 1.
Figure 3:
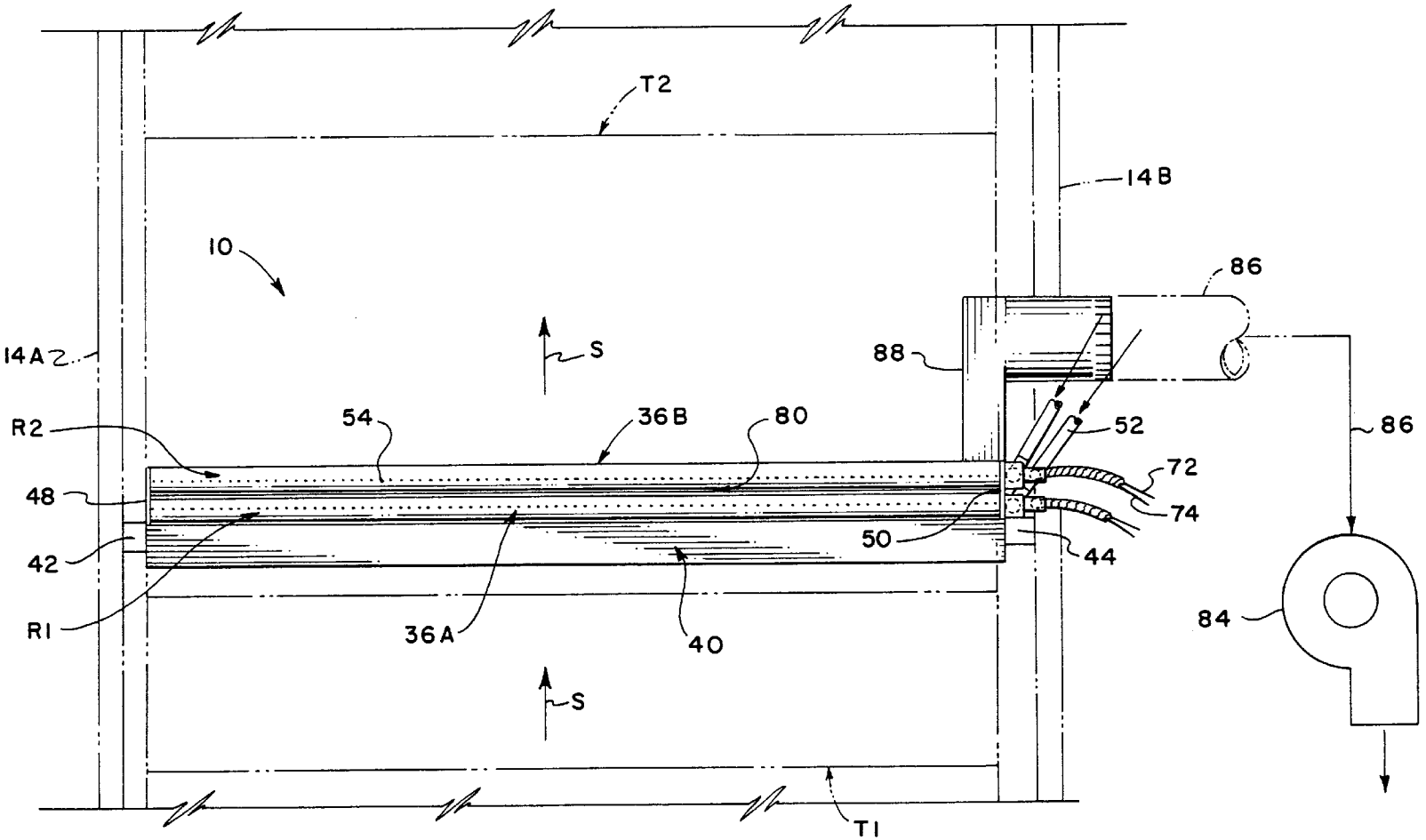
FIG. 3 is a bottom plan view showing installation of the dryer assembly of FIG. 2 in the interstation position.
Figure 5:
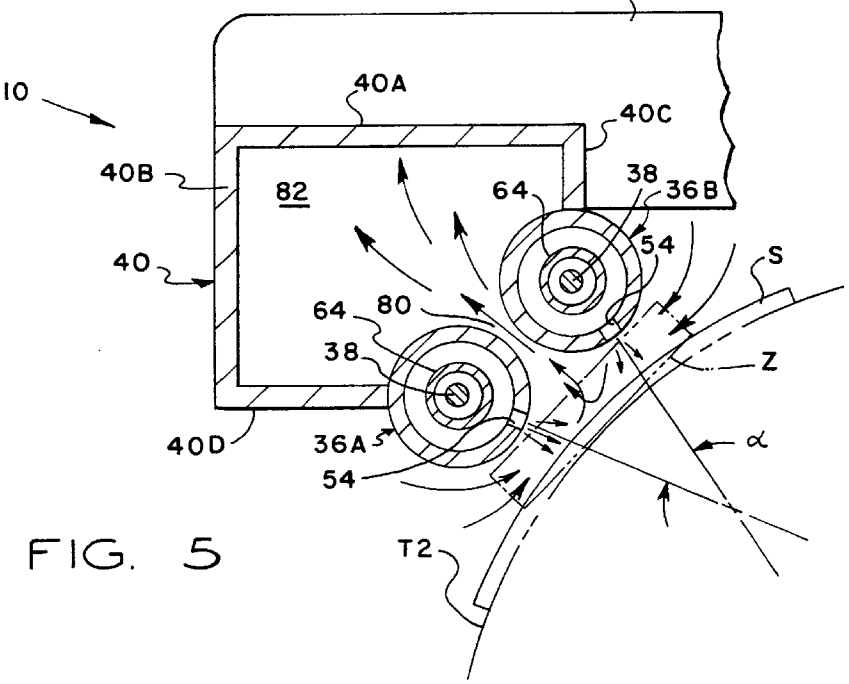
FIG. 5 is a sectional view of the improved dryer of the present invention taken along the line 5—5 of FIG. 4.
Figures 6, 7:
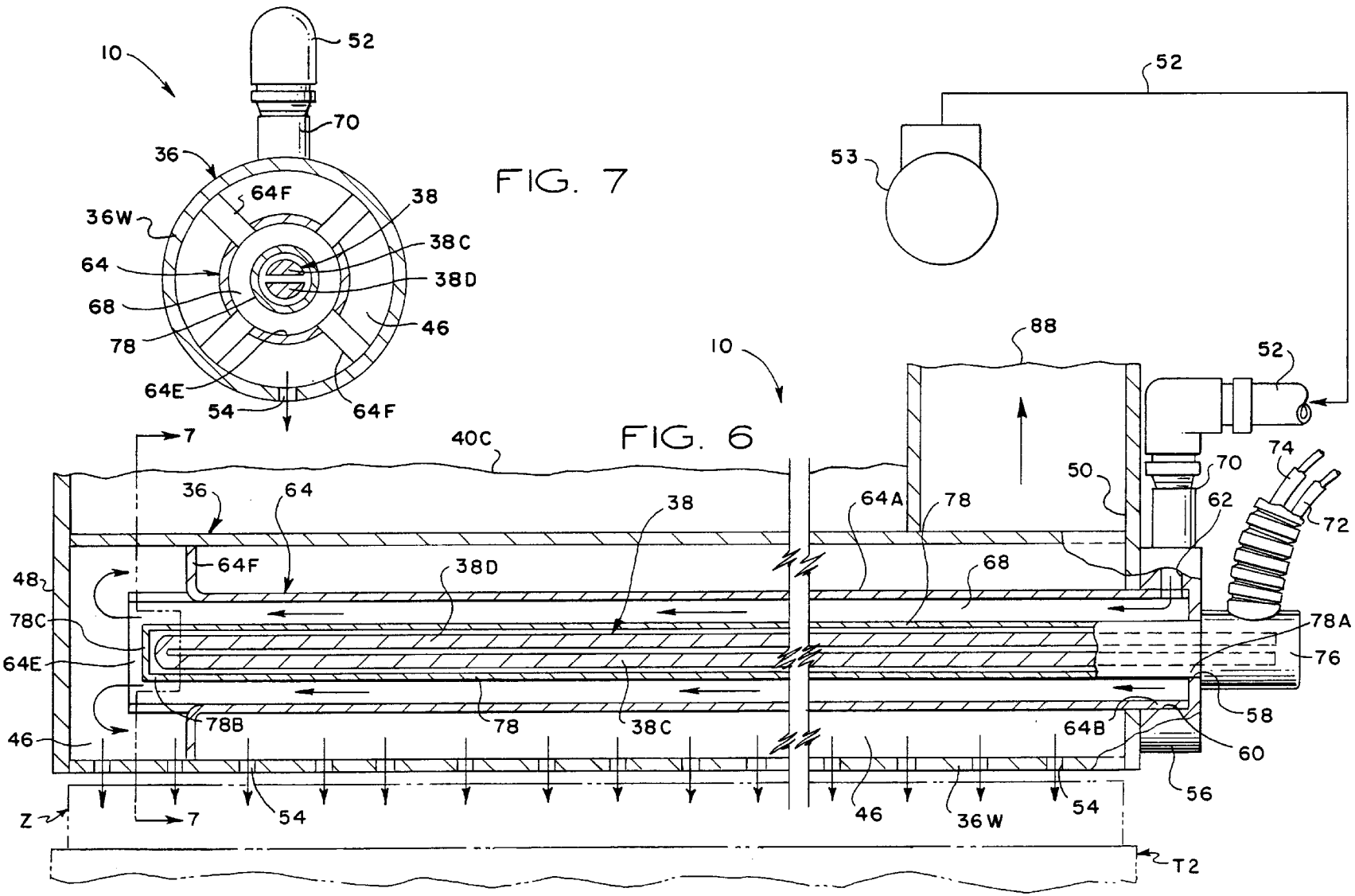
FIG. 6 is a longitudinal sectional view of the dryer assembly shown in FIG. 2.
FIG. 7 is a sectional view of the dryer assembly shown in FIG. 2, taken along the line 7—7 of FIG. 6.
Figure 8:
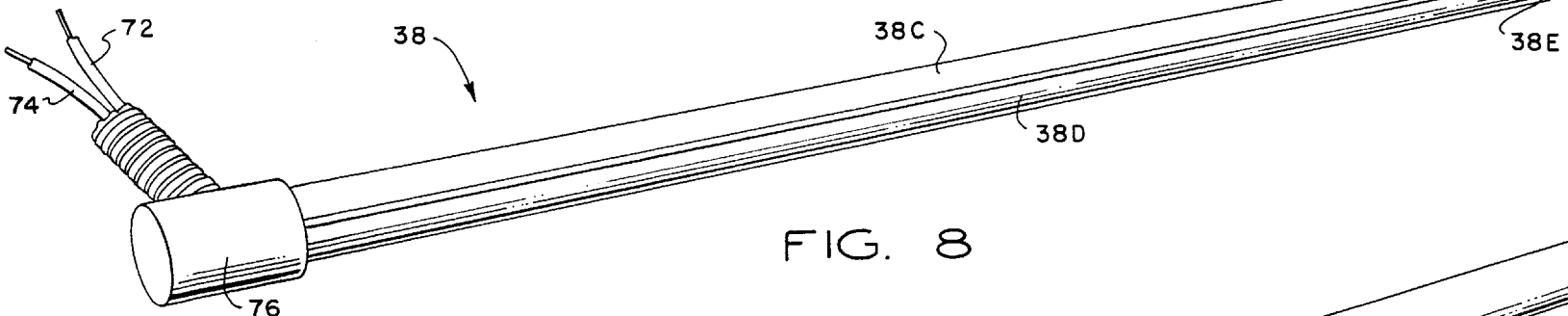
FIG. 8 is a perspective view of a resistance heating element used in the dryer of FIG. 2.
Figure 9:
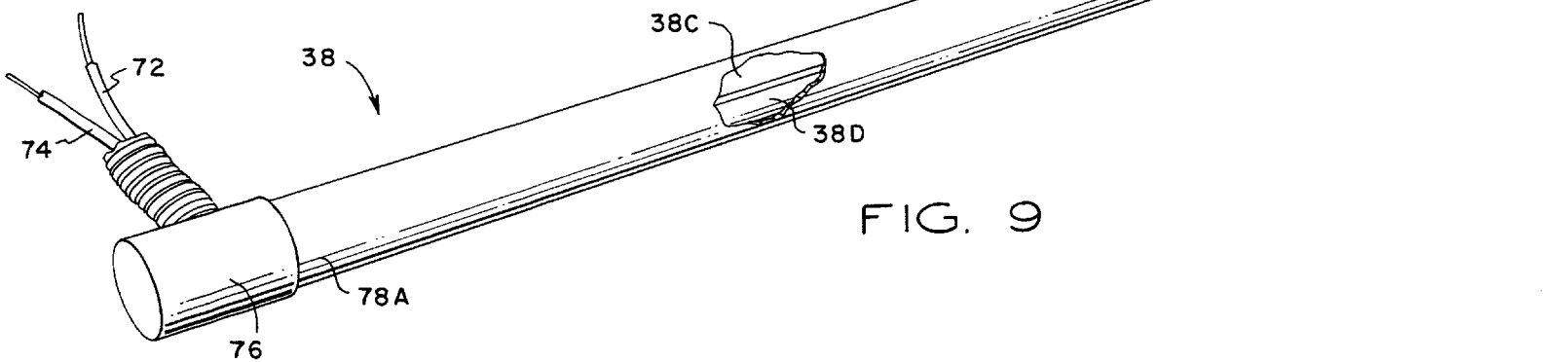
FIG. 9 is a perspective view similar to FIG. 8, with the resistance heating element enclosed in a support sheath.

Referring now to FIG. 2, FIG. 5 and FIG. 6, the interstation dryer 10 includes as its principal components a dryer head 36, a resistance heating element 38, and an extractor head 40. As shown in FIG. 3, the dryer head 36 is mounted on the press side frame members 14A, 14B by side frame flanges 42, 44. In this interstation position, the dryer head 36 is extended laterally across and radially spaced from the interstation transfer cylinder T2, thereby defining an exposure zone Z.

The dryer head 36 includes a tubular sidewall 36W which encloses an air distribution manifold chamber 46. The air distribution manifold housing is sealed on opposite ends by end plates 48, 50, respectively, and is sealed against the extractor head 40. The manifold housing has an inlet port 62 for admitting high velocity, pressurized air through a supply duct 52 from an off-press compressor 53, and has a discharge port 54 for delivering pressurized hot air into the exposure zone Z.

Figure 10:
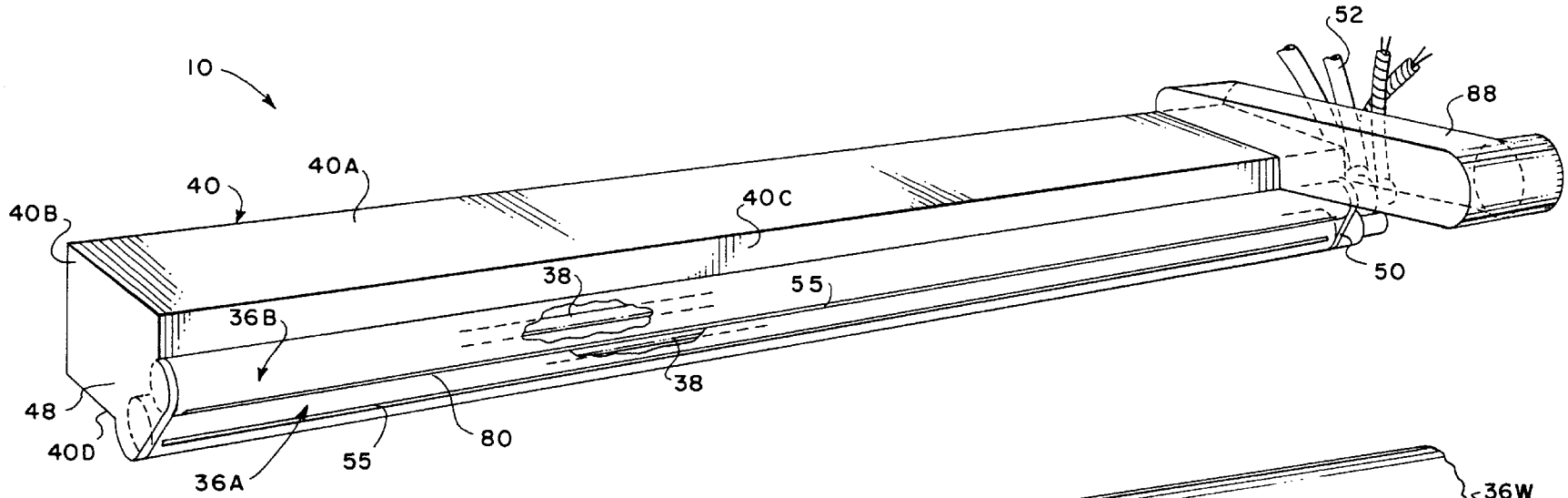
FIG. 10 is a view similar to FIG. 4 which illustrates an alternative embodiment of the dryer head in which the discharge port is formed by an elongated slot; and, FIG. 11 is a perspective view, partially broken away, of the dryer head shown in FIG. 10.
Figure 11:
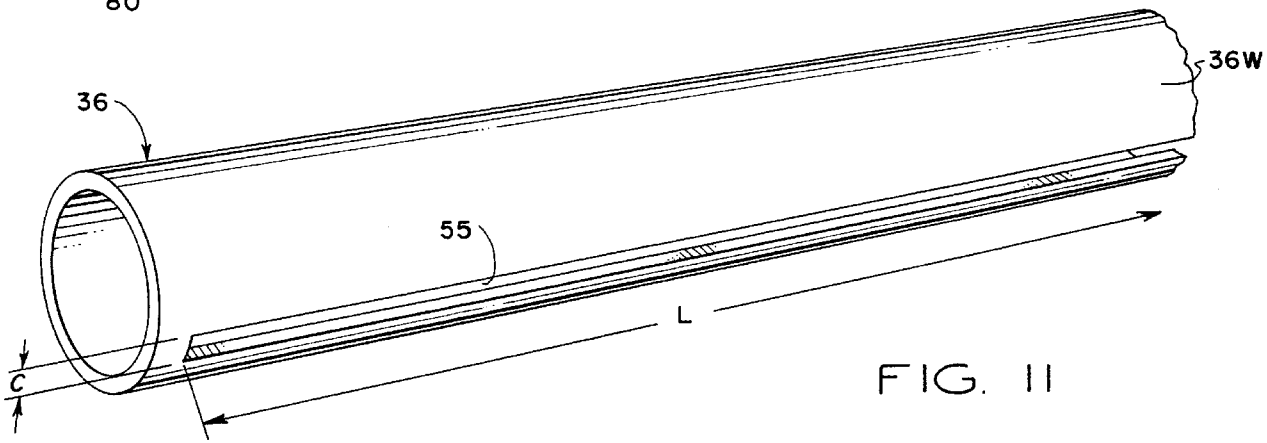

As shown in FIG. 6, the air distribution manifold sidewall 36W is intersected by multiple discharge apertures 54 which collectively define the discharge port. The apertures 54 are oriented for discharging pressurized jets of high velocity, hot air toward the interstation transfer cylinder T2, and are longitudinally spaced along the dryer head 36. According to this arrangement, pressurized air jets are directed along a straight line across the printed side of a sheet S as it moves through the dryer exposure zone Z. In an alternative embodiment, as shown in FIG. 10 and FIG. 11, the discharge port is formed by an elongated slot 55 which intersects the dryer head sideall 36W and extends longitudinally along the dryer head.

Referring now to FIG. 6 and FIG. 7, the resistance heating element 38 is coupled to the dryer head 36 by and end block 56. The end block 56 has a body portion which is intersected by an axial bore 58, a counterbore 60 and a radial inlet bore 62 which communicates with the counterbore. The heating element 38 has an end portion 38A which projects through the axial bore 58 and counterbore 60, with the elongated body portion of the heating element 38 extending into the plenum chamber 46.

According to an important feature of the present invention, the plenum chamber 46 is partitioned by an elongated air delivery baffle tube 64 which extends substantially the entire length of the dryer head 36. The air delivery baffle tube 64 has an inlet port 66 for receiving high velocity airflow from a remote supply and has a tubular sidewall 64A extending through the plenum chamber. The tubular sidewall 64A has an inner airflow passage 68 which connects the inlet port 66 in airflow communication with the plenum chamber 46 through its open end 64E. The air delivery baffle tube 64 has an end portion 64B projecting through the axial bore 60 of the end block 56, with its inner airflow passage 66 in airflow registration with the radial bore 62.

A pneumatic connector 70 is coupled to the radial inlet bore 62 of the end block 56 for connecting the inner airflow passage 68 to an off-press source of high velocity air. The end block 56 is sealed against the end plate 50, the tubular sheath 78 and against the pneumatic connector 70. High velocity, pressurized air is constrained to flow from the air duct 52 into the airflow passage 68 where it is discharged into the air distribution plenum chamber 46 after absorbing heat from the heating element 38.

As shown in FIG. 6, the high velocity air flows longitudinally through the annular flow passage 68 in heat transfer contact with the heating element 38. The high velocity air is heated to a high temperature, for example 350° F. (176° C.), before it is discharged through the airflow apertures 54.

To provide uniform air jet discharge through the apertures 54, the inlet area of the inlet port 66 should be greater than the combined outlet area provided by the multiple airflow discharge apertures 54. In the preferred embodiment, the discharge apertures 54 have a diameter of 1/16 inch (0.158 cm), and for a 40" (102 mm) press there are 88 apertures spaced apart along the dryer head 36 on 0.446 inch (1.13 cm) centers. This yields a total airflow outlet area of 0.269 square inch (1.735 square cm). Preferably, the effective inlet area of the inlet port 66 is at least about 0.54 square inch (3.484 square cm).

In the alternative dryer head embodiment shown in FIG. 10, the air discharge slot 55 has a length of 40 inches (102 mm) along its longitudinal dimension L, and has an arc length C of 6.725 mils ($17\times10^{-3}$ cm).

With the preferred inlet/outlet ratio of about 2:1 or more, the high velocity, heated air will be supplied to the plenum chamber 46 faster than it can be discharged, so that the heated air will be compressed within the manifold plenum chamber. This assures that the jets of hot air which are discharged through the outlet apertures 54 are uniform in pressure and velocity along the length of the dryer head, so that the printed sheet is dried uniformly as it is transferred through the exposure zone Z.

The air distribution baffle tube 64 is supported on the inlet end by the end plate 50, and on its discharge end by flange segments 64F which engage the internal bore of the dryer head 36 and positions the baffle tube in the center of the plenum chamber 46.

Referring now to FIG. 6, FIG. 7, FIG. 8 and FIG. 9, the heating element 38 is preferably an electrical resistance heater having elongated resistance heater sections 38C, 38D which are integrally formed and folded together about at a common end 38E. The resistance sections 38C, 38D are substantially co-extensive in length with the air delivery baffle tube 64. Each section 38C, 38D is electrically connected to a power conductor 72, 74, respectively, for connecting the resistance heating element 38 to an off-press source of electrical power.

The resistance heater sections 38C, 38D are mechanically stabilized by an end connector 76, and are enclosed within a tubular, thermally conductive sheath 78. Radial expansion of the half sections 38C, 38D is limited by the sidewall of the sheath 78, thus assuring efficient heat transfer, while the sheath provides longitudinal support for the elongated resistance heater sections within the inner airflow passage 68. The heating element half-sections 38C, 38D thus form a continuous loop resistance heating circuit which is energized through the power conductors 72, 74.

The tubular sheath 78 is received within the bore 58 and is welded to the end block 56. The tubular sheath 78 thus provides an opening through the end block 56 to permit insertion and withdrawal of the heating element 38 for replacement purposes. The heating element 38 is dimensioned for a sliding fit within the sheath 78 at ambient temperature. The end cap 76 is releasably secured to the end block 56 by a hold-down metal strap (not illustrated). The distal end 78B of the sheath is sealed by an end cap 78C to prevent leakage of high velocity air out of the distribution manifold chamber 46.

Figure 4:
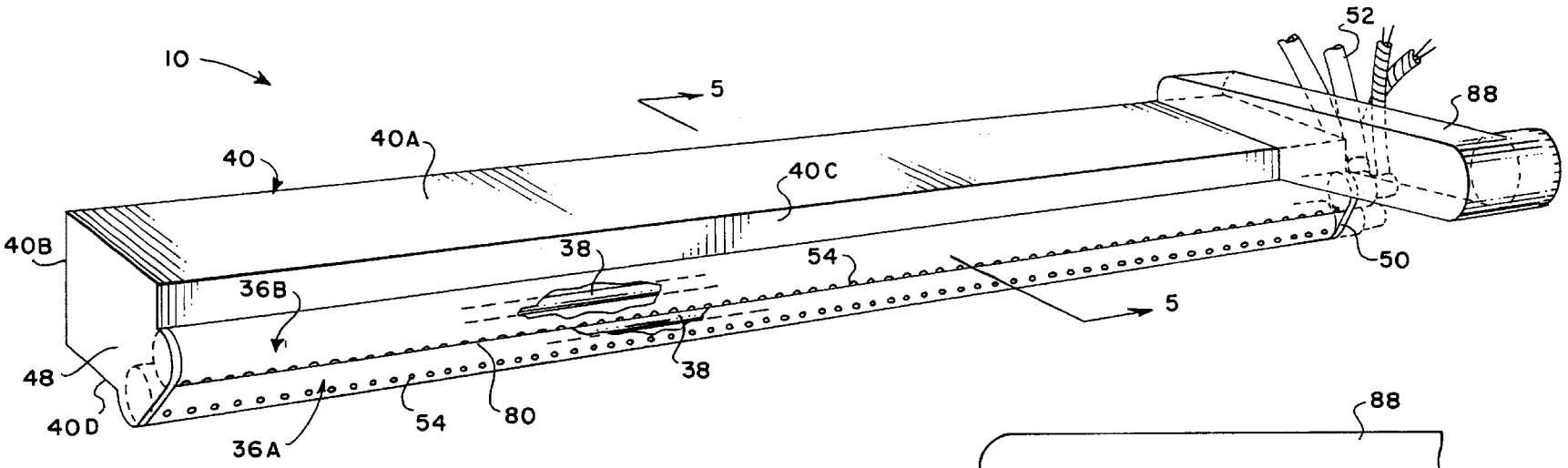
FIG. 4 is a perspective view of the interstation dryer shown in FIG. 2.

Referring now to FIG. 2, FIG. 4, and FIG. 5, the extractor head 40 is coupled to the back side of a pair of identical dryer heads 36A, 36B. The dryer heads 36A, 36B are separated by a longitudinal air gap 80 which opens in air flow communication with an extractor manifold chamber 82, thereby defining a manifold inlet port. The extractor manifold chamber 82 is enclosed by the end plates 48, 50 and by housing panels 40A, 40B, 40C and 40D. The extractor housing panels 40C, 40D are secured and sealed by a welded union to the dryer heads 36A, 36B.

According to another aspect of the present invention, the multiple air flow apertures 54 of each dryer head 36A, 36B are arranged in linear rows R1, R2, respectively, and extend transversely with respect to the direction of sheet travel as indicate by the arrows S in FIG. 3. The rows R1, R2 are longitudinally spaced with respect to each other along the sheet travel path. Each air jet expands in a conical pattern as it emerges from the airflow aperture 54. Expanding air jets from adjacent rows intermix within the exposure zone Z, thereby producing turbulent movement of high velocity hot air which scrubs the processed side of the sheet S as it moves through the exposure zone Z. Preferably, balanced air pressure is applied uniformly across the exposure zone Z to ensure that the moist air layer is completely separated and extracted from the freshly printed sheets.

In the exemplary embodiment, the pressure of the high velocity air as it is discharged through the inlet port 66 into the heat transfer passage 68 is about 10 psi (7031 Kgs/m$^2$). The inlet suction pressure in the longitudinal air gap 80 of the extractor is preferably about 5 inches of water (12.7×10$^3$ Kgs/cm$^3$).

As shown in FIG. 3 and FIG. 5, the extractor manifold inlet port 80 is coupled in air flow communication with the exposure zone Z for extracting heat, moisture laden air and volatiles out of the dryer. The extractor manifold chamber 82 is coupled in air flow communication with an exhaust fan 84 by an air duct 86. The air duct 86 is coupled to the extractor manifold chamber 82 by a transition duct fitting 88.

The high velocity, heated air which is discharged onto the printed sheet S is also extracted through the air gap 80 into the extractor chamber 82. Ambient air, as indicated by the curved arrows, is also suctioned into the exposure zone Z and through the longitudinal air gap, thus assuring that none of the hot air, moisture or volatiles will escape into the press area. Extraction from the exposure zone Z is enhanced by directing the hot air jets along converging lines whose intersection defines an acute angle alpha ($\alpha$), as shown in FIG. 5.

The air flow capacity of the exhaust fan 84 is preferably about four times the total airflow input to the dryer heads. This will ensure that the exposure zone Z is maintained at a pressure level less than atmospheric thereby preventing the escape of hot air, moisture laden air and volatiles into the press room.

Although the present invention and its advantages have been described in detail, it should be understood that various changes, substitutions and alterations can be made herein without departing from the spirit and scope of the invention as defined by the appended claims.

What is claimed is:

1. A hot air dryer comprising, in combination:

a dryer head including an elongated housing member having a tubular sidewall defining a plenum chamber, the tubular sidewall being intersected by an airflow discharge port;

an elongated air delivery tube having an inlet port for receiving high velocity airflow and having a tubular sidewall disposed in the plenum chamber of the dryer head, the tubular sidewall having an inner airflow passage connecting the inlet port in airflow communication with the plenum chamber;

an elongated heating element disposed within the inner airflow passage of the air delivery tube; and, an extractor mounted on the dryer head, the extractor including a housing member defining an air extractor manifold, the extractor housing member being separated from the dryer head by a longitudinal air gap thereby defining an elongated inlet port for extracting moisture laden air from a dryer exposure zone and having a discharge port for exhausting moisture laden air from the extractor manifold.

2. A hot air dryer as defined in claim 1, including:

pneumatic connector means coupled to the air delivery tube for connecting its inner air flow passage to a source of high velocity air.

3. A hot air dryer as defined in claim 1, including:

electrical connector means coupled to the heating element for connecting the heating element to a source of electrical power.

4. A hot air dryer as defined in claim 1, including:

an end block coupled to the housing member and to the air delivery tube for sealing the interface between the air delivery tube and the housing member.

5. A hot air dryer comprising, in combination:

a dryer head including an elongated housing member having a tubular sidewall defining a plenum chamber, the tubular sidewall being intersected by an airflow discharge port;

an elongated air delivery tube having an inlet port for receiving high velocity airflow and having a tubular sidewall disposed in the plenum chamber of the dryer head, the tubular sidewall having an inner airflow passage connecting the inlet port in airflow communication with the plenum chamber;

an elongated heating element disposed within the inner airflow passage of the air delivery tube;

an end block coupled to,the housing member, the end block having a body portion intersected by an axial bore, a counterbore and a radial inlet bore communicating with the counterbore;

the heating element having an end portion projecting through the axial bore and counterbore; and, the air delivery tube having an end portion disposed in the counterbore with its inner airflow passage coupled in airflow communication with the radial inlet bore.

6. A hot air dryer as defined in claim 1, wherein the elongated heating element comprises an electrical resistance heating element, and the dryer head including:

a tubular, thermally conductive sheath disposed within the plenum chamber; and, the electrical resistance heating element being disposed within the sheath.

7. A hot air dryer as defined in claim 6, wherein the electrical resistance heating element has first and second resistance heater sections, the heater sections being joined at a common end and folded together within the sheath.

8. A hot air dryer as defined in claim 5, including:

an elongated extractor coupled to the dryer head, the extractor including a housing member defining an air extractor manifold, the extractor having a housing member separated from the dryer head by a longitudinal air gap defining an elongated inlet port for extracting moisture laden air from a dryer exposure zone and having a discharge port for exhausting moisture laden air from the extractor manifold.

9. A hot air dryer as defined in claim 1, wherein the air discharge port comprises multiple airflow apertures.

10. A hot air dryer as defined in claim 1, wherein the air discharge port comprises an elongated slot.

11. A hot air dryer for use in combination with a printing press of the type having conveyor apparatus for transporting a processed substrate along a sheet travel path comprising, in combination:

first and second elongated dryer heads adapted for side-by-side installation in a position facing the freshly processed side of a substrate as it moves through a dryer exposure zone along the sheet travel path, each dryer head having a housing member defining an air distribution manifold chamber, each air distribution manifold housing member including an inlet port for receiving high velocity air and having a discharge port oriented for directing pressurized air toward the sheet travel path, the dryer heads being separated from each other by a longitudinal air gap;

first and second elongated heating elements disposed within the air distribution manifold chambers of the first and second dryer heads, respectively, for heat exchange contact with high velocity air directed through the respective air distribution manifolds; and, an extractor coupled to the dryer heads, the extractor including a housing defining an extractor manifold chamber coupled in air flow communication with the longitudinal air gap, and having an extractor port coupled in air flow communication with the extractor manifold chamber for exhausting moisture laden air, high velocity hot air and volatiles from the dryer exposure zone.

12. A hot air dryer as defined in claim 11, wherein the discharge ports of each dryer head are arranged in first and second rows, respectively, the rows being separated from each other along the sheet travel path, wherein pressurized air discharged from the discharge ports intermix with each other in the dryer exposure zone.

13. A hot air dryer as defined in claim 11, wherein the discharge ports of the first and second dryer heads are oriented for directing pressurized air along first and second converging lines, respectively.

14. A hot air dryer as defined in claim 11, including:

first and second elongated air delivery tubes disposed in the first and second air distribution manifold chambers, respectively, each air delivery tube having an inlet port for receiving high velocity airflow and having an inner airflow passage connecting its inlet port in airflow communication with the air distribution manifold chamber; and, the elongated heating elements being disposed within the inner airflow passages of the air delivery tubes, respectively.

15. A hot air dryer as defined in claim 11, including:

pneumatic connector means coupled to each air delivery tube for connecting its inner air flow passage to a source of high velocity air.

16. A hot air dryer as defined in claim 11, including:

electrical connector means coupled to each heating element for connecting the heating elements to a source of electrical power.

17. A hot air dryer as defined in claim 11, including:

first and second end blocks coupled to the housing member of each dryer head, respectively, and coupled to the air delivery tube of each dryer head, respectively, for sealing the interface between the air delivery tubes and the housing members.

18. A hot air dryer for use in combination with a printing press of the type having conveyor apparatus for transporting a processed substrate along a sheet travel path comprising, in combination:

first and second elongated dryer heads adapted for side-by-side installation in a position facing the freshly processed side of a substrate as it moves through a dryer exposure zone along the sheet travel path, each dryer head having a housing member defining an air distribution manifold chamber, each air distribution manifold housing member including an inlet port for receiving high velocity air and having a discharge port oriented for directing pressurized air toward the sheet travel path, the driver heads being separated from each other by a longitudinal air gap;

first and second elongated heating elements disposed within the air distribution manifold chambers of the first and second dryer heads, respectively, for heat exchange contact with high velocity air directed through the respective air distribution manifolds;

an extractor coupled to the dryer heads, the extractor including a housing defining an extractor manifold chamber coupled in air flow communication with the longitudinal air gap, and having a discharge port coupled in air flow communication with the extractor manifold chamber for exhausting moisture laden air from the dryer exposure zone;

first and second end blocks coupled to the housing member of each dryer head, each end block having a body portion intersected by an axial bore, a counterbore and a radial inlet bore communicating with the counterbore;

each heating element having an end portion projecting through the axial bore and counterbore; and, each air delivery tube having an end portion disposed in the counterbore with its inner airflow passage coupled in airflow communication with the radial inlet bore.

19. A hot air dryer as defined in claim 11, each elongated heating element comprising an electrical resistance heater.

20. A hot air dryer as defined in claim 11, including:

a tubular, thermally conductive sheath disposed within each air distribution manifold chamber; and, one of the heating elements being enclosed within each sheath.

21. A hot air dryer as defined in claim 11, wherein each elongated heating element comprises an electrical resistance heater having first and second resistance heater sections, the heater sections being joined at a common end and folded together.

22. A dryer for use in combination with a printing press of the type having conveyor apparatus for transporting a freshly processed substrate along a travel path comprising, in combination:

a first dryer head having a housing defining an air distribution manifold chamber, the dryer head housing having an inlet port for admitting pressurized air into the manifold chamber and having a discharge port oriented for directing pressurized air from the manifold chamber into a dryer exposure zone;

a second dryer head having a housing defining a second air distribution manifold chamber, the second dryer head housing having an inlet port for admitting pressurized air into the second manifold chamber and having a discharge port oriented for directing pressurized air from the second manifold chamber into the dryer exposure zone;

the first and second dryer heads being adapted for side-by-side installation on the press in a position facing the freshly processed side of a substrate as it moves through the dryer exposure zone, the dryer heads being separated from each other by a longitudinal air gap; and, an extractor head coupled to the dryer heads, the extractor head including a housing defining an extractor manifold chamber coupled in air flow communication with the longitudinal air gap, and having discharge port means coupled in air flow communication with the extractor manifold chamber for exhausting air from the exposure zone.

23. A dryer as defined in claim 22, wherein the discharge ports comprise multiple air flow apertures disposed in first and second rows, respectively, the rows being separated from each other along the sheet travel path, wherein air jets discharged from air flow apertures of the first and second rows intermix with each other in the exposure zone.

24. A dryer as defined in claim 22, wherein the discharge ports of the first and second dryer heads are oriented for directing pressurized air along first and second converging lines, respectively.

25. A method for drying a freshly printed sheet in a printing press comprising the steps:

directing high velocity air through an air delivery tube which is disposed within the plenum chamber of an air distribution manifold;

heating high velocity air flowing through the air delivery tube by heat transfer contact with an elongated heating element disposed within the air delivery tube;

pressurizing the air distribution plenum chamber with the heated air; and, discharging the pressurized, heated air from the plenum chamber onto the freshly printed sheet.

26. A method for drying a freshly printed sheet as defined in claim 25, including the steps:

discharging the heated, pressurized air from the manifold plenum chamber through an outlet port; and supplying the high velocity air to the manifold plenum chamber through an inlet port having an inlet flow area which is greater than the outlet flow area of the outlet port.

27. A method for drying a freshly printed sheet as defined in claim 25, including the steps:

discharging jets of heated, pressurized air from the manifold plenum chamber through first and second rows of multiple outlet apertures; and intermixing air jets from the first and second rows in an exposure zone.

28. A method for drying a freshly printed sheet as defined in claim 25, including the steps:

discharging jets of heated, pressurized air from the manifold plenum chamber through first and second rows of multiple outlet apertures; and directing air jets discharged from air flow apertures of the first and second rows along first and second converging lines, respectively.

* * * * *